US008665184B2

(12) United States Patent
Lee et al.

(10) Patent No.: US 8,665,184 B2
(45) Date of Patent: Mar. 4, 2014

(54) DRIVING CIRCUIT USED FOR CURRENT-DRIVEN DEVICE AND LIGHT EMITTING DEVICE

(75) Inventors: Chia-Yu Lee, Hsin-Chu (TW); Tze-Chien Tsai, Hsin-Chu (TW)

(73) Assignee: AU Optronics Corp., Hsinchu (TW)

( * ) Notice: Subject to any disclaimer, the term of this patent is extended or adjusted under 35 U.S.C. 154(b) by 456 days.

(21) Appl. No.: 13/026,017

(22) Filed: Feb. 11, 2011

(65) Prior Publication Data

US 2011/0285297 A1 Nov. 24, 2011

(30) Foreign Application Priority Data

May 21, 2010 (TW) ..... 99116316 A

(51) Int. Cl.
*H05B 37/00* (2006.01)
*G09G 3/30* (2006.01)

(52) U.S. Cl.
USPC ..... 345/76; 345/87; 345/102; 345/204; 345/212; 315/160; 315/161; 315/169.3; 257/207; 257/208

(58) Field of Classification Search
USPC ..... 315/160, 161, 169.3; 345/76, 87, 102, 345/204, 212; 257/207, 208
See application file for complete search history.

(56) References Cited

U.S. PATENT DOCUMENTS

| | | | | |
|---|---|---|---|---|
| 7,256,758 | B2 | 8/2007 | Hu et al. | |
| 7,592,975 | B2 | 9/2009 | Yamazaki et al. | |
| 2006/0158393 | A1 * | 7/2006 | Fukumoto et al. | 345/76 |
| 2007/0126690 | A1 * | 6/2007 | Chae | 345/102 |
| 2008/0024480 | A1 * | 1/2008 | Jee et al. | 345/212 |
| 2009/0002405 | A1 | 1/2009 | Ozaki | |
| 2009/0051628 | A1 | 2/2009 | Kwon | |
| 2009/0109147 | A1 * | 4/2009 | Park et al. | 345/76 |

* cited by examiner

*Primary Examiner* — Douglas W Owens
*Assistant Examiner* — Thai Pham
(74) *Attorney, Agent, or Firm* — WPAT, PC; Justin King

(57) ABSTRACT

A driving circuit is adapted to drive a current-driven device. The driving circuit includes a first power supply circuit and a second power supply circuit. The first power supply circuit is for supplying a first positive voltage to a first terminal of the current-driven device. The second power supply circuit is for enabling a current flowing along a first current flow direction in a first time period and thereby a second terminal of the current-driven device is given a second positive voltage. The second power supply circuit further is for enabling a current from the current-driven device flowing out of the second power supply circuit along a second current flow direction. The first current flow direction and the second current flow direction are different directions in the second power supply circuit. Moreover, a light emitting device using the above-mentioned driving circuit also is provided.

7 Claims, 2 Drawing Sheets

DRIVING CIRCUIT USED FOR CURRENT-DRIVEN DEVICE AND LIGHT EMITTING DEVICE

CROSS-REFERENCE TO RELATED APPLICATION

This application claims the priority benefit of Taiwan application serial no. 099116316, filed on May 21, 2010. The entirety of the above-mentioned patent application is incorporated herein by reference and made a part of this specification.

BACKGROUND

1. Technical Field

The present invention generally relates to display technology fields and, particularly to a driving circuit used for a current-driven device and a light emitting device.

2. Description of the Related Art

An organic light emitting diode (OLED) is a type of current-driven device and produces lights with different brightnesses according to currents flowing therethrough. The OLED utilizes transistors cooperative with a storage capacitor to control brightness thereof. Referring to FIG. 1, showing an electrical relationship between an OLED and transistors as well as a storage capacitor associated with the prior art. As illustrated in FIG. 1, a first terminal of the OLED 12 is electrically coupled to a power supply voltage OVDD through a driving transistor M1, a second terminal of the OLED 12 is electrically coupled to another power supply voltage OVSS. Herein, the power supply voltages OVDD and OVSS can be provided by a driving circuit (not shown). The gate of the driving transistor M1 receives a data signal DL through a switching transistor Ms to determine a value of a current flowing through the driving transistor M1, so as to control the brightness of the OLED 12. On-off states of the switching transistor Ms is determined by a scanning signal SCAN electrically coupled to the gate of the switching transistor Ms.

The power supply voltages OVDD and OVSS of the respective first terminal and second terminal of the OLED 12 generally are a positive driving voltage and a negative driving voltage, however the situation of both the two terminals are required to be provided with positive voltages may be encountered in some applications. If the terminals both are provided with positive voltages, since the positive voltages generally are used as power supplies to provide load currents and incapable of providing the function of the load currents flowing back to the power supplies (i.e., current sink), and therefore it is necessary to redesign the driving circuit for providing power supply voltages so that the driving circuit is endowed with functions of voltage stabilization and current sink.

BRIEF SUMMARY

The present invention is directed to a driving circuit used for a current-driven device, having functions of voltage stabilization and current sink.

The present invention further is directed to a light emitting device, a driving circuit used therein has functions of voltage stabilization and current sink.

More specifically, a driving circuit in accordance with an embodiment of the present invention is adapted to drive a current-driven device. The driving circuit includes a first power supply circuit and a second power supply circuit. The first power supply circuit is for providing a first positive voltage to a first terminal of the current-driven device. The second power supply circuit is for enabling a current flowing along a first current flow direction in a first period and providing a second terminal of the current-driven device with a second positive voltage, and further for enabling a current from the current-driven device to flow out of the second power supply circuit along a second current flow direction in a second period. The first positive voltage is greater than the second positive voltage. The first current flow direction and the second current flow direction are different directions in the second power supply circuit.

In one embodiment, the second power supply circuit includes a power source, a voltage maintaining module, a first switch and a second switch. The power source provides an input voltage. The voltage maintaining module enables a current to flow along the first current flow direction after receiving the input voltage. Two terminals of the first switch respectively are electrically coupled to the input voltage and the voltage maintaining module. The first switch is turned on in the first period while is turned off in the second period. The second switch is electrically coupled to a connection node between the first switch and the voltage maintaining module. The second switch is turned off in the first period while is turned on in the second period.

In one embodiment, the second power supply circuit further includes a detection module. The detection module is for outputting a control signal to control the first switch and the second switch whether to be turned on or not. The detection module detects a voltage at the second terminal of the current-driven device and adjusts the control signal according to the voltage at the second terminal of the current-driven device.

In one embodiment, the first switch and the second switch are transistors.

In one embodiment, the second power supply circuit includes a unit gain buffer.

A light emitting device in accordance with an embodiment of the present invention includes a current-driven device and a driving circuit. The current-driven device produces lights with different brightnesses according to different values of a current flowing therethrough. The driving circuit includes a first power supply circuit and a second power supply circuit. The first power supply circuit provides a first positive voltage to a first terminal of the current-driven device. The second power supply circuit is for enabling a current to flow along a first current flow direction in a first period and providing a second terminal of the current-driven device with a second positive voltage, and further for enabling a current from the current-driven device to flow out of the second power supply circuit along a second current flow direction in a second period. The first positive voltage is greater than the second positive voltage. The first current flow direction and the second current flow direction are different directions in the second power supply circuit.

In one embodiment, the second power supply circuit of the light emitting device includes a power source, a voltage maintaining module, a first switch, a second switch and a detection module. The power source provides an input voltage. The voltage maintaining module enables the current to flow along the first current flow direction after receiving the input voltage. Two terminals of the first switch respectively are electrically coupled to the input voltage and the voltage maintaining module. The first switch is turned on in the first period while turned off in the second period. The second switch is electrically coupled to a connection node between the first switch and the voltage maintaining module. The second switch is turned off in the first period while turned on in the second period. The detection module is for outputting a control signal to control the first switch and the second switch whether to be turned on or not. The detection module detects a voltage at the second terminal of the current-driven device and regulates the control signal according to the voltage at the second terminal of the current-driven device.

In one embodiment, both the first switch and the second switch of the light emitting device are transistors.

In one embodiment, the second power supply circuit of the light emitting device includes a unit gain buffer.

In one embodiment, the current-driven device is a semiconductor light emitting diode or an organic light emitting diode.

In summary, in the above-mentioned embodiments, by suitably configuring the circuit structure of the second power supply circuit, e.g., the second power supply circuit is configured to include a power source, a voltage maintaining module, a first switch and a second switch, or the second power supply circuit is configured to include a unit gain buffer, so that the present driving circuit is endowed with functions of voltage stabilization and current sink and therefore is applicable to the circumstance of the two terminals of the current-driven device are provided with positive driving voltages.

Other objectives, features and advantages of the present invention will be further understood from the further technological features disclosed by the embodiments of the present invention wherein there are shown and described preferred embodiments of this invention, simply by way of illustration of modes best suited to carry out the invention.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
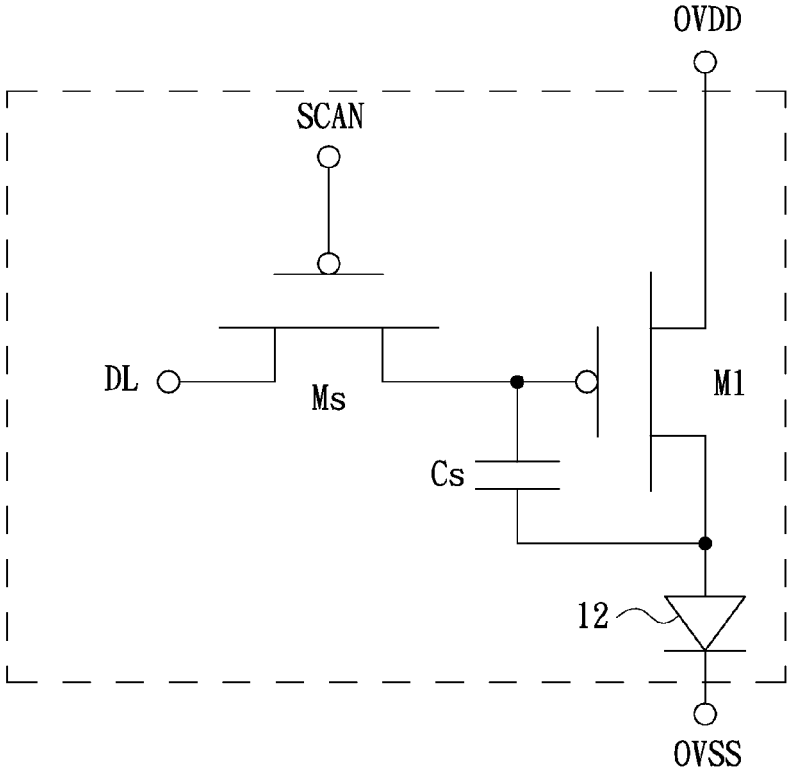
FIG. 1(Related Art)
FIG. 1 shows an electrical connection relationship between an OLED and transistors as well as a storage capacitor, associated with the prior art.
Figure 2:
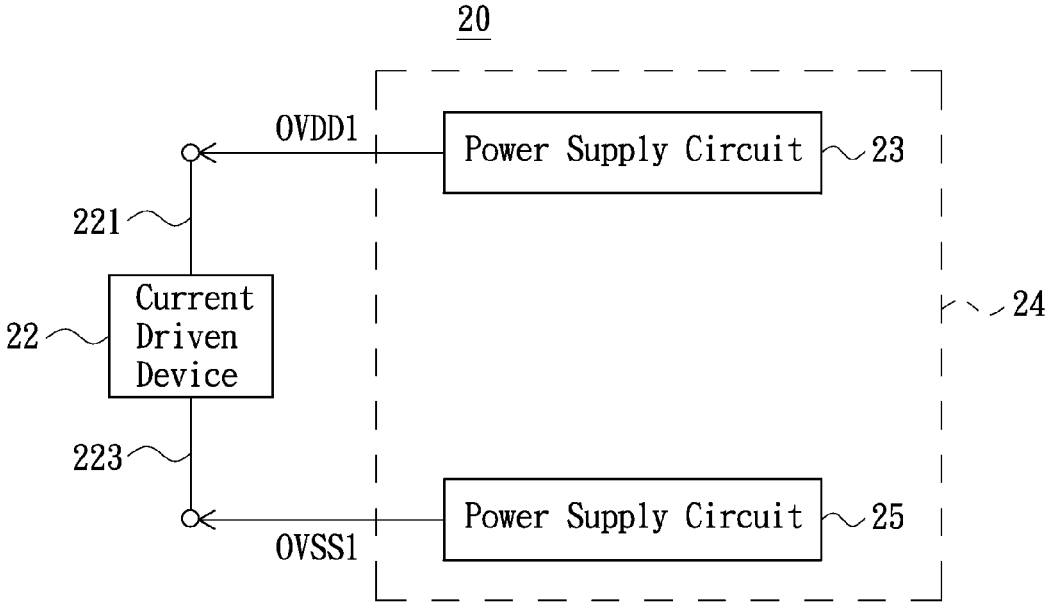
FIG. 2 is a schematic partial structural block diagram of a light emitting device in accordance with an embodiment of the present invention.

Referring to FIG. 2, showing a schematic partial structural block diagram of a light emitting device in accordance with an embodiment of the present invention. As illustrated in FIG. 2, the light emitting device 20 includes a current-driven device 22 and a driving circuit 24. The driving circuit 24 is for providing driving voltages. The current-driven device 22 can be an OLED as illustrated in FIG. 1, using transistors cooperative with a storage capacitor to control the brightness thereof and produces lights with different brightnesses according to different current values flowing therethrough.

The driving circuit 24 includes a power supply circuit 23 and another power supply circuit 25. The power supply circuit 23 is electrically coupled to a first terminal 221 of the current-driven device 22 to provide the current-driven device 22 with a positive voltage OVDD1. Herein, the power supply circuit 23 can be any known power supply circuit having the function of voltage stabilization, and thus detailed circuit diagram thereof will not be repeated. The power supply circuit 25 is electrically coupled to a second terminal 223 of the current-driven device 22 to provide the current-driven device 22 with another positive voltage OVSS1. The positive voltage OVSS1 is lower than the positive voltage OVDD1 in the embodiment.

Figure 3:
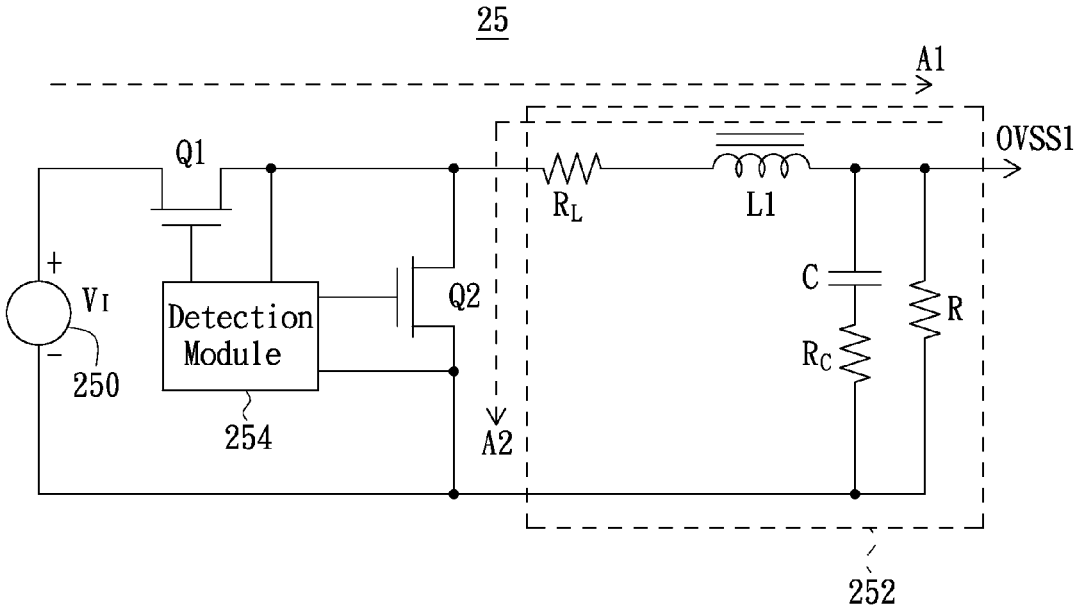
FIG. 3 is a circuit structural configuration of a power supply circuit in accordance with an embodiment of the present invention.

Referring to FIG. 3 together, showing a circuit structural configuration of the power supply circuit 25 in accordance with an embodiment of the present invention. As illustrated in FIG. 3, the power supply circuit 25 includes a power source 250, a voltage maintaining module 252, switches Q1, Q2 and a detection module 254. The power source 250 provides an input voltage $V_I$. The switch Q1 is a transistor in the present embodiment. The drain/source of the switch Q1 is electrically coupled to a positive terminal of the power source 250, the source/drain of the switch Q1 is electrically coupled to the voltage maintaining module 252, and the gate of the switch Q1 is electrically coupled to the detection module 254. The switch Q2 in the present embodiment also is a transistor. The source/drain of the switch Q2 is electrically coupled to a negative terminal of the power source 250, the drain/source of the switch Q2 is electrically coupled to a connection node between the switch Q1 and the voltage maintaining module 252, and the gate of the switch Q2 is electrically coupled to the detection module 254. The detection module 254 is for outputting a control signal to the gates of the switches Q1, Q2 to control the switches Q1, Q2 whether to be turned on or not. The detection module 254 is further electrically coupled to the sources/drains of the switches Q1, Q2, to detect the voltage OVSS1 of the second terminal 223 of the current-driven device 22 and regulate the control signal according to the value of the voltage OVSS1 of the second terminal 223 of the current-driven device 22. More specifically, when the switch Q1 is turned on while the switch Q2 is turned off, a voltage of the source/drain of the switch Q1 is approximately equal to the voltage OVSS1; whereas, when the switch Q2 is turned on while the switch Q1 is turned off, a voltage of the source/drain of the switch Q2 is approximately equal to the voltage OVSS1 of the second terminal 223 of the current-driven device 22. Accordingly, the detection module 254 can detect the value of the voltage OVSS1 of the second terminal 223 of the current-driven device 22 and regulate the control signal based thereon. The voltage maintaining module 252 enables a current to flow along a current flow direction A1 when receiving the input voltage $V_I$ (i.e., when the switch Q1 is turned on). The voltage maintaining module 252 includes a capacitor C, an inductor L1 and resistors $R_L$, $R_C$, R electrically coupled with suitable manner, so as to achieve the purpose of maintaining the voltage OVSS1 to be substantially stable during the period of the switch Q1 being turned off.

In regard to the power supply circuit 25 in the present embodiment, the on-off states of the switches Q1 and Q2 are opposite to each other. In a first period, the switch Q1 is turned on while the switch Q2 is turned off, the input voltage $V_I$ is inputted to the voltage maintaining module 252 through the turned-on switch Q1 and then is processed by the voltage maintaining module 252 to be the positive voltage OVSS1 as an output, i.e., the second terminal 223 of the current-driven device 22 is set to be the voltage OVSS1, the current will flow along the current flow direction A1; when the detection module 254 detects that the positive voltage OVSS1 is up to a preset value, the switch Q1 is turned off while the switch Q2 is turned on, entering in a second period. In the second period, a current discharge path is formed since the turned-on switch Q2, a current flowing from the current-driven device 22 will flow out of the power supply circuit 25 along a current flow direction A2, the input voltage $V_I$ is terminated to input the voltage maintaining module 252 since the switch Q1 is turned off, the voltage maintaining module 252 will approximately maintain the voltage OVSS1 in the second period; when the detection module 254 detects the positive voltage OVSS1 is changed to be lower than a threshold value, the switch Q2 will be turned off while the switch Q1 is turned on, entering in the first period again, so repeatedly.

Figure 4:
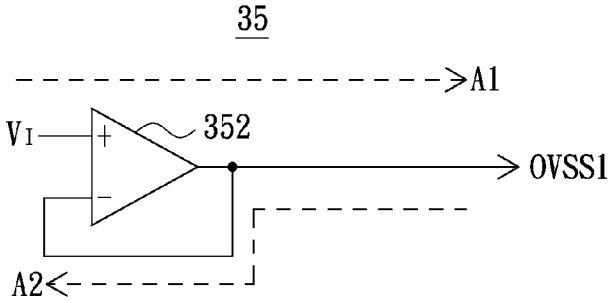
FIG. 4 is a circuit structural configuration of a power supply circuit in accordance with another embodiment of the present invention.

It is noted that, the power supply circuit 25 in the present embodiment is not limited to be the circuit structural configuration as illustrated in FIG. 3, and can have other modified design, for example the circuit structural configuration as illustrated in FIG. 4. In particular, FIG. 4 shows another circuit structural configuration of the power supply circuit for providing the positive voltage OVSS1 in accordance with an embodiment of the present invention, and the power supply circuit is labeled as the numerical reference 35. As illustrated in FIG. 4, the power supply circuit 35 includes a unit gain buffer 352. It is well known that an amplifier has the characteristics of supplying a current and sinking current. In the present embodiment, a non-inverting input terminal (+) of the unit gain buffer 352 is electrically coupled to receive the input voltage $V_P$, an inverting input terminal (−) of the unit gain buffer 352 is electrically coupled to an output terminal of the unit gain buffer 352 for the purpose of voltage stabilization, and the output terminal of the unit gain buffer 352 is suitable for providing the positive voltage OVSS1 to the second terminal 223 of the current-driven device 22. Herein, in the first period, the input voltage V1 is provided to the non-inverting input terminal (+) of the unit gain buffer 352, the output terminal of the unit gain buffer 352 then outputs the positive voltage OVSS1, the current will flow along the current flow direction A1, so that the second terminal 223 of the current-driven device 22 is set to be the positive voltage OVSS1. When the outputted positive voltage OVSS1 from the output terminal of the unit gain buffer 352 is up to the preset value, the input voltage $V_I$ is terminated to provide to the non-inverting input terminal (+) of the unit gain buffer 352, entering in the second period. In the second period, since the inverting input terminal (−) and the output terminal of the unit gain buffer 352 are electrically coupled with each other to form a current discharge path, so that a current flowing from the current-driven device 22 will flow out f the power supply circuit 35 along the current flow direction A2.

In addition, the current-driven device 22 in the embodiments of the present invention is not limited to be the OLED as illustrated in FIG. 1, and can be a semiconductor LED instead. Moreover, the skilled person in the art can make a modification(s) applied to the circuit structural configuration of the driving circuit associated with the above-mentioned embodiments, as long as the driving circuit can have the functions of voltage stabilization and current sink.

In summary, in the above-mentioned embodiments of the present invention, by suitably configuring the circuit structure of the second power supply circuit, e.g., the second power supply circuit is configured to include a power source, a voltage maintaining module, a first switch and a second switch, or the second power supply circuit is configured to include a unit gain buffer, so that the present driving circuit is endowed with functions of voltage stabilization and current sink and therefore is applicable to the circumstance of both the two terminals of the current-driven device are required to be provided with positive driving voltages.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A driving circuit adapted to drive a current-driven device, comprising:

a first power supply circuit, for providing a first positive voltage to a first terminal of the current-driven device; and a second power supply circuit, for enabling a current to flow along a first current flow direction in a first period and providing a second terminal of the current-driven device with a second positive voltage, and for enabling a current flowing from the current-driven device in a second period to flow out of the second power supply circuit along a second current flow direction, so that the driving circuit is endowed with functions of voltage stabilization and current sink;

wherein the first current flow direction and the second current flow direction are different directions in the same conductive line of the second power supply circuit, wherein the second power supply circuit comprises:

a power source, for providing an input voltage;

a voltage maintaining module, for enabling the current to flow along the first current flow direction after receiving the input voltage;

a first switch, two terminals of the first switch being electrically coupled to the input voltage and the voltage maintaining module, the first switch being turned on in the first period while turned off in the second period; and a second switch, electrically coupled to a connection node between the first switch and the voltage maintaining module, the second switch being turned off in the first period while turned on in the second period.

2. The driving circuit as claimed in claim 1, wherein the second power supply circuit further comprises:

a detection module, for outputting a control signal to control the first switch and the second switch whether to be turned on or not, wherein the detection module detects a voltage at the second terminal of the current-driven device and regulates the control signal according to the voltage of the second terminal of the current-driven device.

3. The driving circuit as claimed in claim 1, wherein the first switch and the second switch are transistors.

4. A light emitting device, comprising:

a current-driven device, for producing lights with different brightnesses according to different values of a current flowing therethrough; and a driving circuit, comprising:

a first power supply circuit, for providing a first positive voltage to a first terminal of the current-driven device; and a second power supply circuit, for enabling a current to flow along a first current flow direction in a first period and providing a second terminal of the current-driven device with a second positive voltage, and for enabling a current flowing from the current-driven device in a second period to flow out of the second power supply circuit along a second current flow direction, so that the driving circuit is endowed with functions of voltage stabilization and current sink;

wherein the first current flow direction and the second current flow direction are different directions in the same conductive line of the second power supply circuit, wherein the second power supply circuit comprises:

a power source, for providing an input voltage;

a voltage maintaining module, for enabling the current to flow along the first current flow direction after receiving the input voltage;

a first switch, two terminals of the first switch being electrically coupled to the input voltage and the voltage maintaining module, the first switch being turned on in the first period while turned off in the second period;

a second switch, electrically coupled to a connection node between the first switch and the voltage maintaining module, the second switch being turned off in the first period while turned on in the second period; and a detection module, for outputting a control signal to control the first switch and the second switch whether to be turned on or not, wherein the detection module detects a voltage at the second terminal of the current-driven device and regulates the control signal according to the voltage at the second terminal of the current-driven device.

5. The light emitting device as claimed in claim 4, wherein the first switch and the second switch are transistors.

6. The light emitting device as claimed in claim 4, wherein the current-driven device comprises a semiconductor light emitting diode or an organic light emitting diode.

7. A driving circuit adapted to drive a current-driven device, comprising:

a first power supply circuit, for providing a first positive voltage to a first terminal of the current-driven device; and a second power supply circuit, for enabling a current to flow along a first current flow direction in a conductive line in a first period and providing a second terminal of the current-driven device with a second positive voltage, and for enabling a current flowing from the current-driven device in a second period to flow out of the second power supply circuit in the conductive line along a second current flow direction;

wherein the first current flow direction and the second current flow direction are different directions in the same conductive line of the second power supply circuit, wherein the second power supply circuit comprises:

a power source, for providing an input voltage;

a voltage maintaining module, for enabling the current to flow along the first current flow direction after receiving the input voltage;

a first switch having two terminals, the two terminals being directly coupled to the input voltage and the voltage maintaining module, the first switch being turned on in the first period while turned off in the second period; and a second switch directly coupled to a connection node between the first switch and the voltage maintaining module, the second switch being turned off in the first period while turned on in the second period.

* * * * *